United States Patent [19]

Reba

[11] Patent Number: 4,542,842

[45] Date of Patent: Sep. 24, 1985

[54] PNEUMATIC CONVEYING METHOD FOR FLEXIBLE WEBS

[75] Inventor: Imants Reba, Vancouver, Wash.

[73] Assignee: Crown Zellerbach Corporation, San Francisco, Calif.

[21] Appl. No.: 669,401

[22] Filed: Nov. 8, 1984

Related U.S. Application Data

[62] Division of Ser. No. 546,779, Oct. 31, 1983, Pat. No. 4,505,412.

[51] Int. Cl.[4] ..... B65H 35/10

[52] U.S. Cl. ..... 225/2; 83/98; 83/402; 225/4; 225/96; 225/100

[58] Field of Search ..... 225/2, 4, 96, 100, 106, 225/95, 97; 34/156; 83/98–100, 402

[56] References Cited

U.S. PATENT DOCUMENTS

| | | | |
|---|---|---|---|
| 3,721,375 | 3/1973 | Roberts et al. | 225/100 X |
| 4,472,886 | 9/1984 | Reba | 226/97 X |
| 4,472,888 | 9/1984 | Spiller | 226/97 X |
| 4,484,500 | 11/1984 | Reba et al. | 83/98 |
| 4,499,801 | 2/1985 | Reba et al. | 83/99 X |
| 4,505,412 | 3/1985 | Reba | 225/96 |

*Primary Examiner*—Frank T. Yost
*Assistant Examiner*—John L. Knoble
*Attorney, Agent, or Firm*—Thomas R. Lampe

[57] ABSTRACT

A method for conveying a web using inner and outer pairs of elongated side jet nozzles employing the Coanda effect to propel the web while preventing undue distortion or folding thereof. Conveying is accomplished by flowing pressurized air through a plurality of apertures formed in the nozzles and attaching air flow to Coanda flow attachment surfaces slanting away from the apertures.

8 Claims, 3 Drawing Figures

PNEUMATIC CONVEYING METHOD FOR FLEXIBLE WEBS

This application is a division of application Ser. No. 06/546,779, filed Oct. 31, 1983, now U.S. Pat. No. 4,505,412.

BACKGROUND OF INVENTION

This invention relates to an apparatus and method for conveying a web of thin flexible material between two locations while providing stability to the web. The illustrated preferred embodiment of the invention has particular relevance to the conveying of plastic film used to wrap articles, but it will be appreciated that the system may be employed in other operating environments as well.

Both mechanical and pneumatic conveyor systems exist in the prior art for conveying plastic wrap and other plastic webs. Conventional mechanical systems, for example systems using vacuum belts or opposed nip forming belts to convey plastic webs, are difficult to maintain and don't perform adequately. Such arrangements are often complex and are not adapted to handle a broad range of web gauges or weights. It has been found, for example, that mechanical devices often lose efficiency as web gauge is reduced. Web instability, particularly in the form of edge flutter and inadvertent folding over of the material, is often a problem with such prior art devices. Obviously, these failings result in a poor wrap and reduced production rates.

Applicant's co-pending U.S. patent application Ser. No. 06/375,793, filed May 7, 1982, relates to an air conveyor system; however, the invention disclosed in that application is used for serially conveying discrete flexible articles, and is not appropriate to the conveying of continuous webs, the specific area which the present system addresses.

While there are pneumatic web conveyors in existence, as stated above, such systems do not maintain sufficient control over the web to prevent distortion thereof, particularly in the corners and at the edges, to enable such systems to be employed with plastic film. For example, the pneumatic conveyor shown in applicant's U.S. Pat. No. 4,186,860, while operating highly satisfactorily for many types of web material, does not have the capability of transporting plastic webs under sufficient edge control to allow the film to arrive at its destination in undistorted condition.

BRIEF SUMMARY OF THE INVENTION

According to the teachings of a preferred embodiment of the present invention, elongated side jet nozzles are used to convey a web of thin flexible material from a first location to a second location along a predetermined plane and direction of web movement. There are two pairs of jet nozzles—an inner pair and an outer pair. Each of the side jet nozzles has wear surface defining means, flow attachment surface defining means positioned adjacent to the wear surface defining means, and aperture defining means positioned between the wear surface defining means and flow surface defining means.

The apertures of the nozzles are so configured and positioned as to direct pressurized air emitted therefrom at a direction generally parallel to the plane of web movement and a predetermined first angle relative to the direction of web movement. The flow attachment surfaces of the nozzles slant away from the apertures to redirect a portion of the pressurized air in a direction diverging from the plane of movement at a second angle due to the Coanda effect. Both of the first and second angles of the outer side jet nozzles are greater than the respective first and second angles of the inner side jet nozzles in order to efficiently convey the web while preventing harmful distortion thereof during such conveyance.

DETAILED DESCRIPTION

Figure 1:
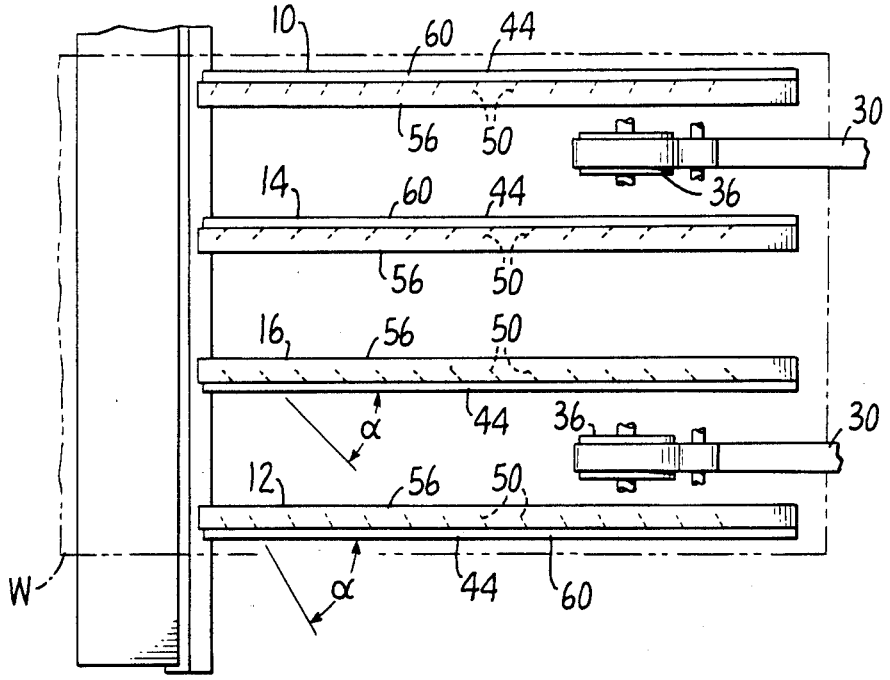
FIG. 1 is a schematic plan view of a preferred form apparatus constructed in accordance with the teachings of the present invention.

Referring now to the drawings, a preferred form of apparatus constructed in accordance with the teachings of the present invention is illustrated. The apparatus includes a pair of elongated outer side jet nozzles 10, 12 and a pair of inner side jet nozzles 14, 16. The side jet nozzles are disposed in parallel and extend between a first location and a second location, and are adapted to pneumatically convey a web W of thin flexible material (shown in phantom) between said first and second locations along a predetermined plane and direction of web movement.

In the illustrated embodiment, the first location is defined by a rotatable cutter 20 having blades 22 thereon which cooperate with fixed severing element 24 to form cross machine cuts in the moving web W in a well known manner. Also, as is well known in the art, each blade 22 has spaced nicks or indents (not shown) in its cutting edges so that after the cut is made, the partially severed portion of the web is still partially connected to the feed stock.

Figure 2:
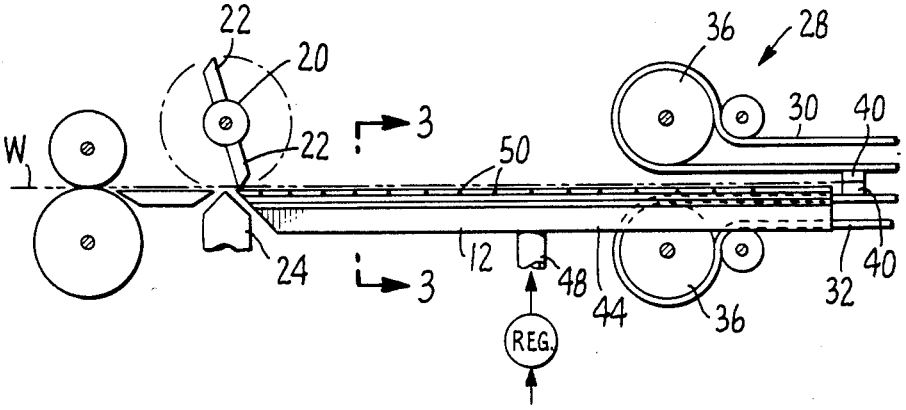
FIG. 2 is a side view of the apparatus of FIG. 1.

The second location of the illustrated embodiment also accomodates a piece of equipment well known in the plastic web converting art, i.e. a tab belt system identified generally by reference numeral 28. Such system includes an upper pair of belts 30 and lower pair of belts 32 in registry therewith. The belts are looped around idler sheaves 36 and driven by any suitable prime mover mechanism (not shown) so that the upper belts 30 rotate in a counter clockwise manner as viewed in FIG. 2 and the lower belt 32 rotate at the same speed in a clockwise fashion as viewed in that figure. The belts 30 and 32 have tabs 40 mounted thereon at predetermined locations so that the tabs 40 come into registry upon rotation of the belts with the web W pinched therebetween. Because the speed of the belts and tabs is faster than the speed of the web W as it is fed under previously described rotatable cutter 20, the partially severed web portion engaged by the tabs is pulled and completely separated from the remainder of the web. The belts 30, 32 then transport the cut-off piece of film to a wrapping station or other suitable end location.

The side jet nozzles 10, 12, 14 and 16 cooperate to convey web W from the first location to the second location while preventing undue distortion or folding of the web W, which would interfere with proper operation of the downstream equipment. Each side jet nozzle includes a body member 44 defining a cavity 46 connected by means of a conduit 48 to a suitable source of pressurized air (not shown). Apertures 50 are formed in the body 44 and are interconnected to cavity 46 by a passageway 52.

Wear surface defining means in the form of a chamfered plate 56 is positioned over apertures 50 with the upper wear surface thereof providing a smooth support for web W.

Each side jet nozzle additionally includes flow attachment surface defining means in the form of a plate 60 having one edge thereof positioned underneath the outlet of apertures 50.

Apertures 50 of nozzles 10, 14 are generally opposed to apertures 50 of nozzles 12, 16. All apertures 50 are so configured and positioned as to direct pressurized air emitted therefrom at a direction generally parallel to the plane of web movement and at a predetermined first angle alpha relative to the direction of web movement. The flow attachment surfaces defined by plates 60 slant away from the apertures 50 to redirect a portion of the pressurized in a direction diverging from the plane of movement at a second angle beta due to the Coanda effect.

Figure 3:
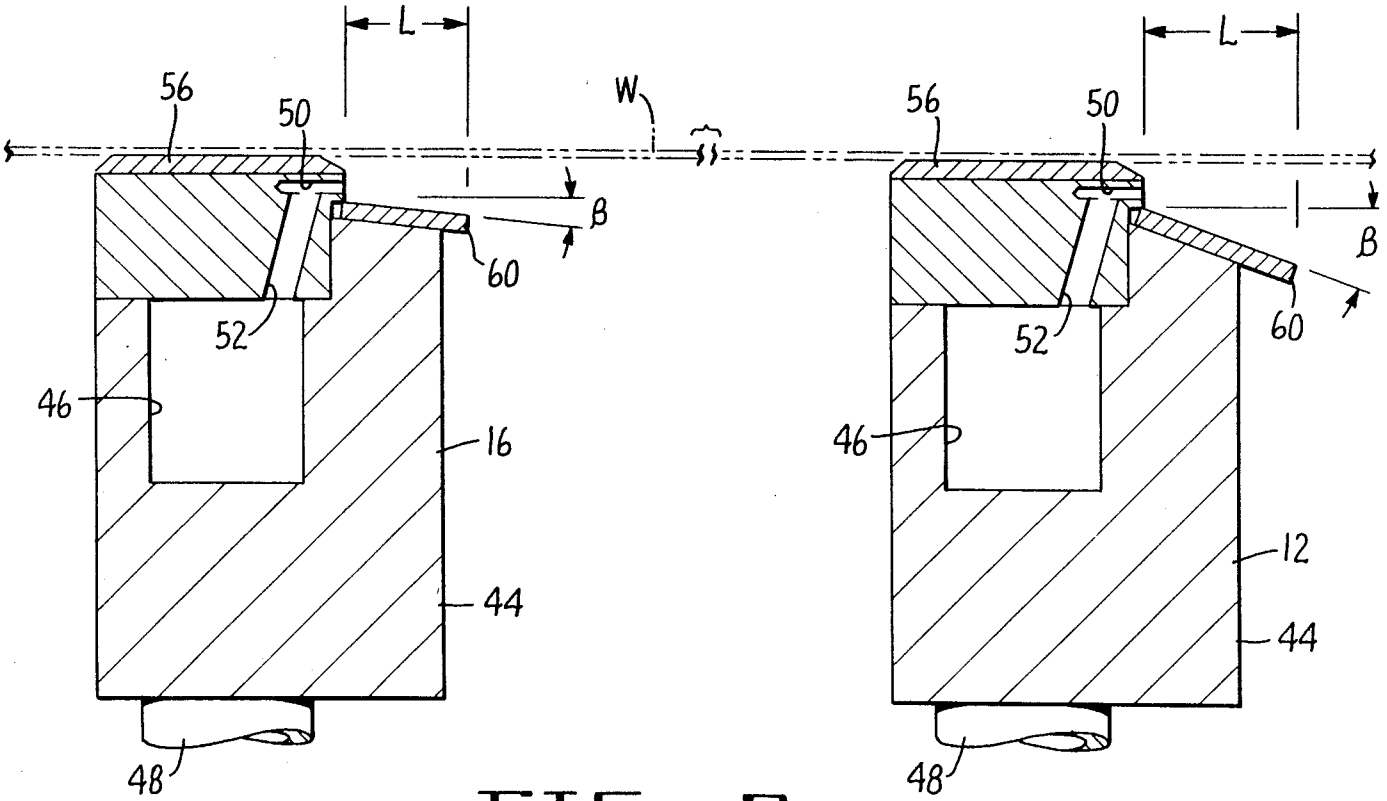
FIG. 3 is an enlarged cross sectional view taken along line 3—3 of FIG. 2 and showing the cross section of an inner side jet nozzle and an outer side jet nozzle.

An important feature of the present invention is that the first and second angles of the outer side jet nozzles 10, 12 are greater in magnitude than the corresponding first and second angles of the inner side jet nozzles 14, 16. As may perhaps best be seen with reference to FIG. 3, the plate 60 of each nozzle overhangs its main body 44. As pressurized air exits from apertures 50 a portion thereof will attach itself to plates 60 due to the Coanda effect and flow downwardly along the upper surface of each plate 60 and continue outwardly beyond the overhanging part of the plate to produce a fluid dynamical support to the overhanging web material. The steeper the angle beta, the more suction of downward pull is created; hence, larger lateral spread. Similarly, the smaller the angle alpha of apertures 50, the greater the propelling action generated. In the illustrated preferred embodiment, the outer side jet nozzles must provide an adequate lateral stretch of web W and good control of the web edge. A suitable angle beta at the outer side jet nozzles for accomplishing this function in a desirable manner has been found to be 20°. As to angle alpha of the outer side jet nozzles, it has been found that 60° relative to the direction of web movement provides an adequate edge support and also an adequate propelling force along the sides of the web.

The function of the two inner nozzles, on the other hand, is to provide some lateral stretch of the wrap and a strong driving or propelling force between the first and second locations. Consequently, apertures 50 form an angle alpha in the plane of motion of 45°. To minimize friction between the nozzles and the web W, the flow attachment surface of plate 60 associated with the inner nozzles was slanted at an angle beta equaling 5°. Reduction of the angle beta value minimizes downward pull—hence, a tendency of the web to sag or dip in the spaces between the nozzles. If desired, additional support for the web between the nozzles may be provided by stationery web support rails (not shown) between the nozzles. It will also be appreciated that the values given above for angles alpha and beta may be modified in accordance with the requirements of a given situation.

Another variable employed to control air flow is to vary the width L of plates 60. It is preferred that the width L of the outer nozzles be greater in magnitude than the width L of the inner nozzles since, generally speaking, a wider plate 60 will bring the Coanda effect into play to a greater degree than will a lesser width plate. In an actual apparatus constructed as shown in the preferred embodiment, the width L of the outer nozzles was 5/16 of an inch and the width L of the inner nozzles was $\frac{1}{4}$ inch.

In the disclosed preferred embodiment, both the plates 56 and 60 are attached to the main nozzle body by a suitable mechanical expedient such as screws. Both plates are exposed to considerable wear over a period of time so it is preferred that they be readily replaceable. Also, by making the plates separate components, they can be made of a wear resistent material such as stainless steel while the nozzle body itself can be made from a material such as aluminum, thus greatly reducing manufacturing costs.

Change of web material in terms of its gauge, stiffness characteristics of surface properties dictate the use of appropriate air pressure delivered to the nozzles. In an experimental working embodiment used to convey plastic film, air to the outer nozzles was supplied at a pressure of from about 8 to about 15 psig, with both outer nozzles using the same pressure. However, if the web W does not steer properly, the outer nozzles can be operated at different pressures to provide corrective action. The two inner nozzles on apparatus constructed in accordance with the teachings of the present invention were operated within a range of from about 5 to about 7 psig. The apertures 50 employed were 1/32 of an inch spaced about $\frac{1}{2}$ inch apart for both the inner and the outer nozzles.

I claim:

1. A method for conveying a web of thin flexible material from a first location to a second location along a predetermined plane and direction of web movement comprising the steps of:

along the outer edges of said web and under said web, introducing pressurized air at spaced outer positions extending along outer parallel lines between said first and second locations;

substantially simultaneously with the step of introducing pressurized air at said spaced outer positions, introducing pressurized air along the central portion of said web and under the web at spaced inner positions extending along inner parallel lines between said first and second locations;

initially directing the pressurized air from said spaced inner and outer positions in a direction generally parallel to the plane of web movement and at a predetermined first angle relative to the direction of web movement; and redirecting a portion of said pressurized air in a direction diverging from said plane of movement at a second angle due to the Coanda effect, said angle being defined by the plane of movement and a flow attachment surface, the first angle at said outer positions being greater than the first angle at said inner positions and the second angle at said outer positions being greater than the second angle at said inner positions.

2. The method of claim 1 including the additional steps of partially severing the web along spaced lines of cut at said first location to form web sections between said lines of cut and applying a force to said web sections at said second location to separate said sections.

3. The method of claim 1 wherein the first angle at said outer positions is in the order of 60°.

4. The method of claim 1 wherein the first angle at said inner positions is in the order of 45°.

5. The method of claim 1 wherein the second angle at said outer positions is in the order of 20°.

6. The method of claim 1 wherein the second angle at said inner positions is in the order of 5°.

7. The method of claim 1 wherein the air introduced at said spaced outer positions is pressurized within a range of from about 8 to about 15 psig.

8. The method of claim 1 wherein the air introduced at said spaced inner positions is pressurized within a range of from about 5 to about 7 psig.

* * * * *